US005936491A

United States Patent [19]

Ono

[11] Patent Number: 5,936,491

[45] Date of Patent: Aug. 10, 1999

[54] DIELECTRIC FILTER

[75] Inventor: Shoji Ono, Aichi, Japan

[73] Assignee: NGK Spark Plug Co., Ltd., Aichi, Japan

[21] Appl. No.: 08/953,233

[22] Filed: Oct. 17, 1997

[30] Foreign Application Priority Data

Oct. 18, 1996 [JP] Japan ..... 8-297518

[51] Int. Cl.[6] ..... H01P 1/205

[52] U.S. Cl. ..... 333/206; 333/207

[58] Field of Search ..... 333/202, 206, 333/207, 222, 223

[56] References Cited

U.S. PATENT DOCUMENTS

| | | | |
|---|---|---|---|
| 4,745,379 | 5/1988 | West et al. | 333/206 |
| 4,768,003 | 8/1988 | Kawakami et al. | 333/223 X |
| 4,855,093 | 8/1989 | Matsukura et al. | 333/207 X |
| 4,987,393 | 1/1991 | Yorita et al. | 333/207 X |
| 5,146,193 | 9/1992 | Sokola | 333/206 |
| 5,218,329 | 6/1993 | Vangala et al. | 333/206 |
| 5,525,946 | 6/1996 | Tsujiguchi et la. | 333/202 |

FOREIGN PATENT DOCUMENTS

| | | | |
|---|---|---|---|
| 60-254802 | 12/1985 | Japan | 333/202 |
| 62-104201 | 5/1987 | Japan . | |

OTHER PUBLICATIONS

Patent Abstracts of Japan, vol. 9, No. 181 (E–331), Jul. 26, 1985 & JP 60 052102 A (OKI Denki Kogyo KK), Mar. 25, 1985.

Patent Abstracts of Japan, vol. 9, No. 318 (E–366), Dec. 13, 1985 & JP 60 152102 A (Murata Seisakusho:KK)), Aug. 10, 1985.

*Primary Examiner*—Seungsook Ham
*Attorney, Agent, or Firm*—Larson & Taylor

[57] ABSTRACT

In a dielectric filter comprising a dielectric ceramic block which is provided with three or more than three resonators arranged in parallel with each other and a pair of input/output pads formed on a lateral side of the dielectric ceramic block, arranged at locations close to the open top of the dielectric ceramic block and facing the respective outer resonators and capacitively coupled to the respective outer resonators, the effective resonant length of the outer resonators is increased by forming extended conductors extending from the respective edges of the openings of the outer resonators to minimize the effect of the input/outputs and make the resonant frequencies of the outer resonators agree with that of the central resonator.

4 Claims, 3 Drawing Sheets

DIELECTRIC FILTER

BACKGROUND OF THE INVENTION

1. Field of the Invention

The present invention relates to a dielectric filter comprising a plurality of dielectric resonators arranged in parallel with each other.

2. Prior Art

There are known dielectric filters of the type comprising a rectangularly parallelepipedic dielectric ceramic block, three or more than three resonators provided by boring so many through holes in the dielectric ceramic block and coating the peripheral walls thereof with an inner conductor and an outer conductor covering the outer peripheral surface of the dielectric ceramic block, excepting one end surface of the dielectric ceramic block which forms an open circuit end on which one opening ends of the through holes are positioned.

FIGS. 1 and 2 of the accompanying drawings show a conventional dielectric filter of the above identified type with three resonators A and B, wherein a pair of input/output pads P are provided on a lateral side surface of the dielectric ceramic block, arranged at locations close to the open circuit end surface of the dielectric ceramic block and facing the respective outer resonators B and capacitively coupled to the respective outer resonators B, each of said input/output pads P being separated from the outer conductor C by an insulating zone D surrounding it. Such conventional dielectric filter is disclosed in U.S. Pat. No. 5,146,193.

While each of the resonators A and B is normally made to have a length equal to $\lambda/4$ or a quarter of the specified resonant frequency, the above arrangement of input/output pads P disposed vis-a-vis the respective outer resonators B at locations close to the open circuit end surface gives rise to a problem that the resonant frequency of the outer resonators B is increased due to the provision of the input/output pads P separated from the outer conductor C by respective insulating zones D and the partial removal of the outer conductor and consequently the resonant frequency of the outer resonators comes to disagree with that of the central resonator A at the cost of filtering performance.

This problem may be dissolved by forming a recess E in a central area of the bottom or short circuit end surface of the dielectric ceramic block as shown in FIGS. 1 and 2 to make the resonant length of the outer resonators B longer than that of the central resonator A and shift the resonant frequency of the resonators B downward in advance in order to compensate the raised resonant frequency of the outer resonators B caused by the input/output pads P and make the resonant frequencies of all the resonators A and B consequently agree with each other. FIG. 2 of Japanese Patent Kokai No. 62-104201 discloses one example of this frequency compensating method.

It should be noted, however, that a conductive film F is formed on the short circuit end surface of the dielectric ceramic block in such known dielectric filter and connected to the edges of the other opening ends of the resonators on the short circuit end surface. The conductive film F is typically prepared by a screen printing which is adapted to mass production. However, with the configuration of the dielectric filter of FIGS. 1 and 2 having a recess E formed in a central area of the short circuit end, the screen printing technique cannot feasibly be used and the conductive film F has to be formed by applying a conductive material to that side by means of a brush at the cost of manufacturing efficiency. In short, such a configuration is not adapted to mass production.

It is therefore an object of the present invention to provide a dielectric filter that can make the resonant frequencies of the resonators agree with each other and, at the same time, capacitively couple the input/output pads and the respective outermost resonators without requiring the formation of a recess on the short-circuiting end of a dielectric ceramic block.

SUMMARY OF THE INVENTION

According to the present invention, the above object is achieved by providing a dielectric filter comprising a dielectric ceramic block, three or more than three resonators formed by boring so many through holes in the dielectric ceramic block and coating the peripheral walls thereof with an inner conductor, an outer conductor covering a specific area of the outer peripheral surface of the dielectric ceramic block excepting one end surface of the dielectric ceramic block which forms an open circuit end surface on which one opening ends of the through holes are positioned, and a pair of input/output pads formed on a lateral side surface of the dielectric ceramic block, arranged at locations close to the open circuit end surface of the dielectric ceramic block and facing the respective outermost resonators and capacitively coupled to the respective outermost resonators, each of said input/output pads being separated from the outer conductor by an insulating zone surrounding it, wherein additional conductors are provided on the open circuit end surface of said dielectric ceramic block, which extend from edges of the one opening ends of the outermost resonators for increasing the resonant length of each of the outermost resonators.

Each of the additional conductors may be outwardly extended along an axis across all the resonators.

Alternatively, each additional conductor may be extended in one or two directions perpendicular to the axis across the resonators.

Each of the additional conductors may have a width substantially equal to the diameter of the respective through holes.

With the above arrangement, the outermost resonators are made to have a length slighter longer than the length corresponding to their proper resonant frequency in order to show a low initial resonant frequency. Then, the effect of the upward shift of the resonant frequency of the outermost resonators caused by the input/output pads that are formed close to the open circuit end surface of the dielectric ceramic block and separated from the outer conductor by respective insulating zones is offset by the low initial resonant frequency so that a dielectric filter having a proper resonant frequency will be realized.

DETAILED DESCRIPTION OF THE INVENTION

Now, the present invention will be described by referring to the accompanying drawings that illustrate preferred embodiments of the present invention. The components that are common to all the embodiments are denoted respectively by the same reference symbols and will not be described duplicatively.

Figure 1:
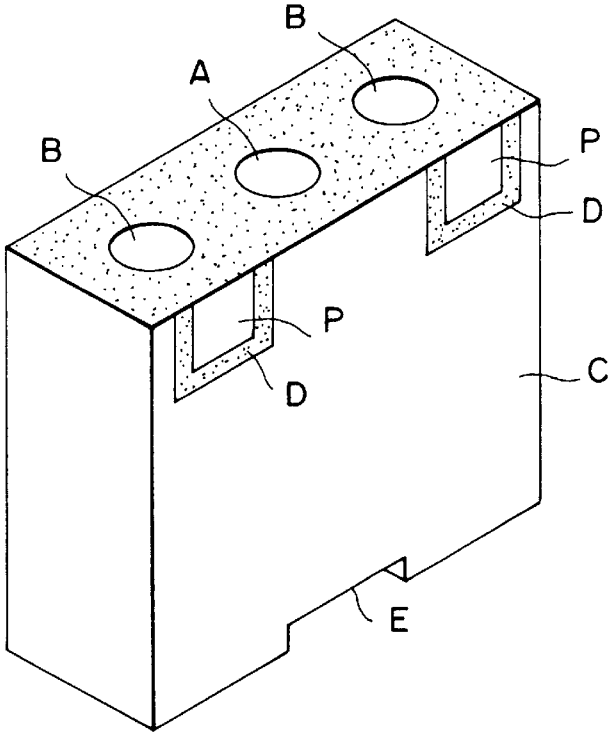
FIG. 1 PRIOR ART
FIG. 1 is a schematic perspective view showing a conventional dielectric filter of the type under consideration.
Figure 2:
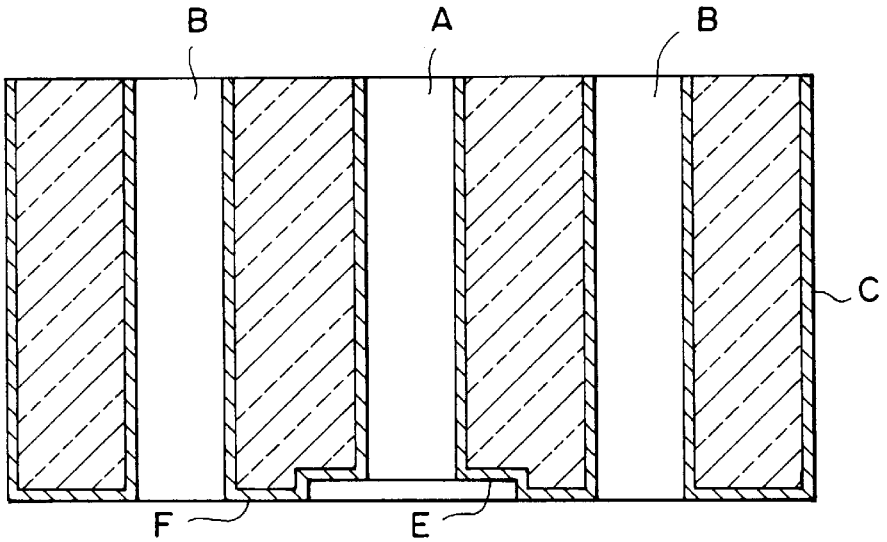
FIG. 2 PRIOR ART
FIG. 2 is a schematic longitudinal section of the dielectric filter of FIG. 1.
Figure 3:
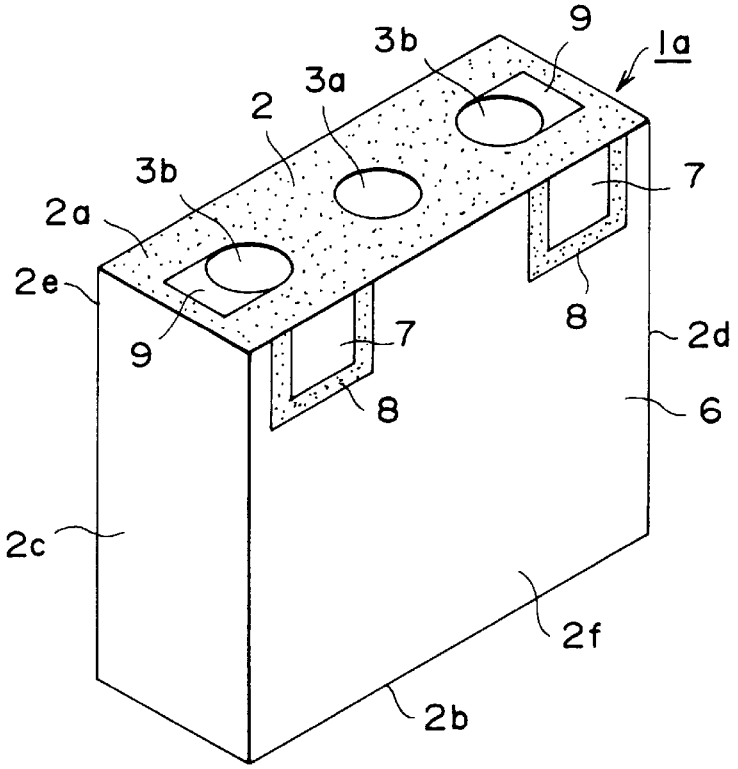
FIG. 3 is a schematic perspective view showing an embodiment of a dielectric filter according to the present invention.
Figure 4:
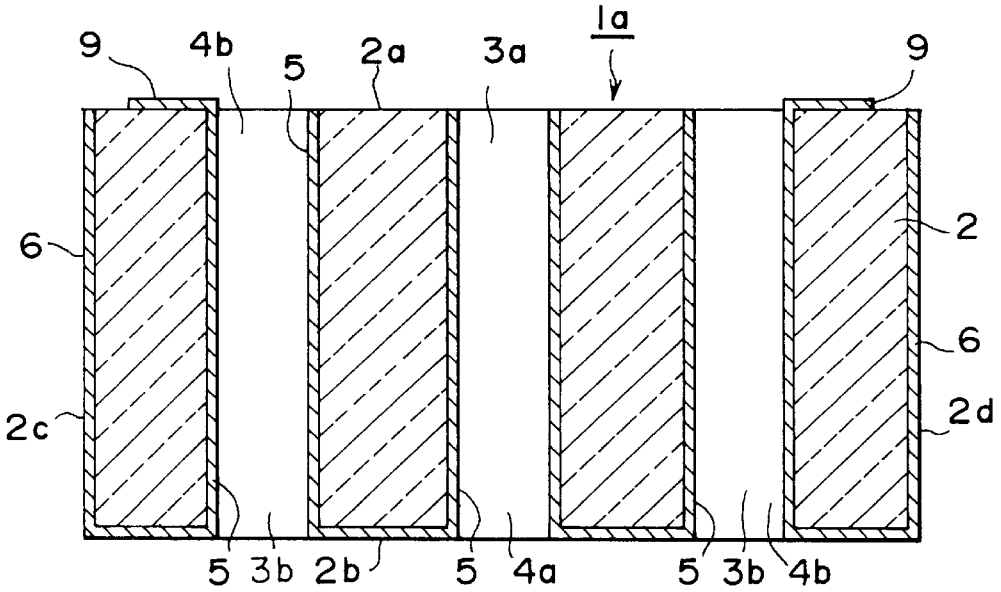
FIG. 4 is a schematic longitudinal section of the dielectric filter of FIG. 3, illustrating its principal components.

FIGS. 3 and 4 illustrate a first embodiment of a dielectric filter according to the present invention, which is a three stage type dielectric filter 1*a* comprising a dielectric ceramic block 2 on which three resonators 3*a* and 3*b* are provided. The dielectric ceramic block 2 of the dielectric filter 1*a* is rectangularly parallelepipedic having six outer surfaces 2*a*, 2*b*, 2*c*, 2*d*, 2*e* and 2*f*, and made of a titanium oxide type ceramic material. The resonators 3*a* and 3*b* are arranged in parallel with each other between the lateral side surfaces 2*c* and 2*d* of the block 2. They are formed by covering the peripheral walls of through holes 4*a* and 4*b* provided on the dielectric ceramic block 2 with respective inner conductors 5. The outer surfaces 2*b*, 2*c*, 2*d*, 2*e* and 2*f* of the dielectric ceramic block 2 are coated with an outer conductor 6 except the outer surface 2*a* which forms an open circuit end surface on which the corresponding opening ends of the through holes 4*a* and 4*b* are positioned. The outer conductor 6 operates as a shield electrode. Each of the resonators 3*a* and 3*b* has a length substantially equal to λ/4 or a quarter of the specified resonant frequency for an intended dielectric filter.

A pair of input/output pads 7 are formed on the lateral side surface 2*f* of the dielectric ceramic block 2, arranged at locations close to the open circuit end surface 2*a* of the dielectric ceramic block 2 and facing the respective outer resonators 3*b* and capacitively coupled to the respective outer resonators 3*b*. Each of said input/output pads 7 is separated from the outer conductor 6 by an insulating zone 8 surrounding it. The input/output pads 7 will be electrically connected to an electric path on a printed circuit board not shown.

It should be noted here, however, that the input/output pads 7 formed on the lateral side surface 2*f* of the dielectric ceramic block 2 at locations facing the respective outer resonators 3*b* raise the resonant frequency of the resonators 3*b*. Since the conductor lengths defined respectively by the through holes 4*a* and 4*b* of the resonators 3*a* and 3*b* are identical with each other, the provision of the input/output pads 7 makes the resonant frequency of the resonators 3*b* higher than that of the central resonator 3*a*. Consequently, such a dielectric filter does not provide a satisfactory filtering effect.

However, in the above embodiment of dielectric filter, or dielectric filter 1*a*, according to the present invention, in order that the resonant frequencies of the resonators 3*a* and 3*b* are made to agree with each other, frequency adjusting or compensating conductors 9 are provided on the open circuit end surface 2*a* of the dielectric ceramic block 2, which are extended from the inner conductors 5 of the respective outer resonators 3*b* to increase the effective resonant length of the outer resonators 3*b*. As shown in FIG. 4, each conductor 9 is outwardly extended along the axis across the three resonators 3*a* and 3*b* and has a width substantially equal to the diameter of the respective through holes 4*b*. This arrangement is advantageous to produce an intended dielectric filter because each of the additional conductors 9 may be easily produced without requiring very high accuracy in the positioning thereof. Also, the extension lenght of each conductor 9 may be determined in dependence on the design for an intended dielectric filter.

Thus, the effect of raising the resonant frequency of the outer resonators 3*b* by the input/output pads 7 arranged on a lateral side surface 2*f* of the dielectric ceramic block 2 at locations close to the open circuit end surface 2*a* of the block 2 and facing the respective outer resonators 3*b* can be offset by the above arrangement of the extended conductors 9 for increasing the effective resonant length and hence lowering the resonant frequency of the outer resonators 3*b* in advance to achieve a resonant frequency substantially equal to λ/4 to the dielectric filter and the resonant frequencies of the resonators can be made substantially agree with each other.

Figure 5:
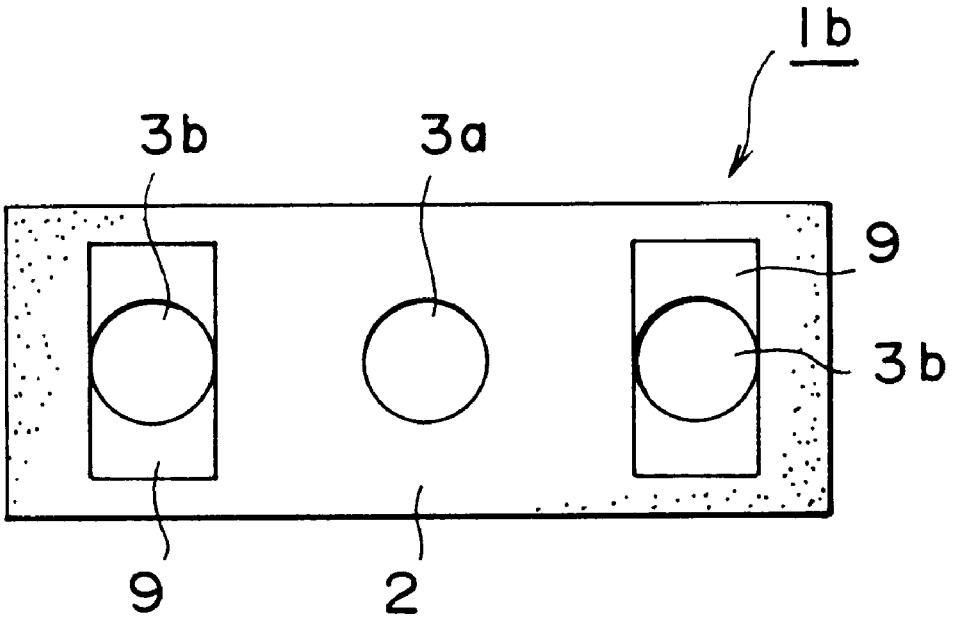
FIG. 5 is a schematic plan view of another embodiment of a dielectric filter according to the present invention.

FIG. 5 illustrates a dielectric filter 1*b* according to another embodiment of the present invention.

The frequency adjusting or compensating conductors 9 are formed by extending the respective outer resonators sideways in two directions, that is the conductors 9 are provided so that they are extended along two directions perpendicular to the axis across the three resonators 3*a* and 3*b*. Alternatively, the conductors 9 may be provided to be extended only in one direction perpendicular to the axis across the three resonators 3*a* and 3*b*.

Additionally, while the resonators 3*a* and 3*b* of the above embodiments have a circular cross section, they may alternatively have a cross section that is square or of some other geometric form.

As described above, in any of the embodiments of dielectric filter according to the invention, comprising a pair of input/output pads arranged on a lateral side surface of the dielectric ceramic block at locations close to the open circuit end surface and facing the respective outer resonators, each of said input/output pads being separated from the outer conductor by an insulating zone surrounding it, the effect of raising the resonant frequency of the outer resonators by the provision of the input/output pads can be offset by the provision of extended conductors for increasing the effective resonant length and hence lowering the resonant frequency of the outer resonators in advance. Thus, such a dielectric filter can minimize the adverse effect of the input/output pads and the resonant frequencies of the resonators can be made substantially agree with each other.

I claim:

1. A dielectric filter comprising a dielectric ceramic block, at least three resonators, each of said resonators having the same length and said resonators being formed by boring corresponding through holes in the dielectric ceramic block and coating peripheral walls of said through holes with an inner conductor, an outer conductor covering a specific area of an outer peripheral surface of the dielectric ceramic block except for one end surface of the dielectric ceramic block which forms an open circuit end on which one of the opening ends of each of the through holes is positioned, and a pair of input/output pads formed on a lateral side surface of the dielectric ceramic block, arranged at locations close to the open circuit end surface of the dielectric ceramic block and facing the respective outermost resonators and being capacitively coupled to the respective outermost resonators, each of said input/output pads being separated from the outer conductor by an insulating zone surrounding the outer conductor, and only the outermost resonators associated with the respective input/output pads being provided with respective additional conductors for increasing the resonant length of each of the outermost resonators, each of said additional conductors being arranged on the open circuit end surface of said dielectric ceramic block so as to extend from an edge of a respective said one of the opening ends of the corresponding outermost resonator.

2. A dielectric filter as claimed in claim 1, wherein said each additional conductor extends outwardly along an axis extending across all of the resonators.

3. A dielectric filter as claimed in claim 1, wherein said each additional conductor extends in two opposite directions from, and perpendicular to, an axis extending across the resonators.

4. A dielectric filter as claimed in claim 1, wherein said each additional conductor has a width substantially less than the length thereof and substantially equal to the diameter of the respective through hole.

* * * * *